US009919322B2

(12) United States Patent
Kim et al.

(10) Patent No.: US 9,919,322 B2
(45) Date of Patent: Mar. 20, 2018

(54) CAPSULE AND ELECTROSTATIC ATOMIZING DEVICE THEREOF

(71) Applicant: LG ELECTRONICS INC., Seoul (KR)

(72) Inventors: Woojin Kim, Seoul (KR); Hyungho Park, Seoul (KR); Jongsun Jeon, Seoul (KR); Jaeseung Choi, Seoul (KR); Jieun Choi, Seoul (KR); Hayoung Kim, Seoul (KR); Hyunjung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 281 days.

(21) Appl. No.: 14/430,418

(22) PCT Filed: Sep. 11, 2013

(86) PCT No.: PCT/KR2013/008193
§ 371 (c)(1),
(2) Date: Mar. 23, 2015

(87) PCT Pub. No.: WO2014/046414
PCT Pub. Date: Mar. 27, 2014

(65) Prior Publication Data

US 2015/0251200 A1 Sep. 10, 2015

(30) Foreign Application Priority Data

Sep. 24, 2012 (KR) ..... 10-2012-0105834

(51) Int. Cl.
*B05B 5/025* (2006.01)
*B05B 5/035* (2006.01)
(Continued)

(52) U.S. Cl.
CPC ..... *B05B 5/0255* (2013.01); *B01F 3/0407* (2013.01); *B05B 5/035* (2013.01);
(Continued)

(58) Field of Classification Search
CPC ..... B05B 5/025; B05B 5/0255; B05B 5/035; B05B 5/0533; B05B 5/0536; B05B 5/057;
(Continued)

(56) References Cited

U.S. PATENT DOCUMENTS 5,186,869 A * 2/1993 Stumpf ..... F24F 3/12 261/30
5,196,171 A 3/1993 Peltier
(Continued)

FOREIGN PATENT DOCUMENTS

CN 1148327 4/1997
JP 2008-528221 A 7/2008
(Continued)

OTHER PUBLICATIONS

International Search Report dated Dec. 19, 2013 issued in Application No. PCT/KR2013/008193 (full English text).
(Continued)

*Primary Examiner* — Darren W Gorman
(74) *Attorney, Agent, or Firm* — KED & Associates LLP

(57) ABSTRACT

The present invention relates to an electrostatic atomizing device of a disposable capsule, wherein the capsule in accordance with an embodiment may include an ejection pin having a functional water solution impregnated therein, a sealing member for sealing the ejection pin, and a pressing member for pushing the ejection pin with external force to move the ejection pin such that a portion of the ejection pin penetrates the sealing member and is projected to an outside of the capsule, and the electrostatic atomizing device in accordance with an embodiment may include a hole for receiving a capsule, and a voltage applying portion in the hole so as to be brought into contact with an ejection pin
(Continued)

being projecting to an outside of the capsule received in the hole for applying a voltage to the ejection pin in contact with thus.

6 Claims, 5 Drawing Sheets

(51) Int. Cl.

| | |
|---|---|
| ***B05B 5/053*** | (2006.01) |
| ***B05B 5/057*** | (2006.01) |
| ***B05B 5/16*** | (2006.01) |
| ***F24F 3/12*** | (2006.01) |
| ***B01F 3/04*** | (2006.01) |

(52) U.S. Cl.
CPC ..... *B05B 5/057* (2013.01); *B05B 5/0533* (2013.01); *B05B 5/0536* (2013.01); *B05B 5/1691* (2013.01); *F24F 3/12* (2013.01); *B01F 2215/009* (2013.01)

(58) Field of Classification Search
CPC ..... B05B 5/1691; B01F 3/0407; B01F 2215/009; F24F 3/12
See application file for complete search history.

(56) References Cited

U.S. PATENT DOCUMENTS

| | | | | |
|---|---|---|---|---|
| 5,337,963 | A * | 8/1994 | Noakes | B05B 5/16 239/690 |
| 5,503,335 | A * | 4/1996 | Noakes | B05B 5/0255 239/145 |
| 5,810,265 | A * | 9/1998 | Cornelius | A01M 1/205 239/44 |
| 5,927,618 | A * | 7/1999 | Jefferies | B05B 5/0255 239/44 |
| 5,992,771 | A * | 11/1999 | Noakes | A61M 15/0045 136/255 |
| 6,326,062 | B1 * | 12/2001 | Noakes | A61M 15/0045 118/620 |
| 6,729,552 | B1 * | 5/2004 | McEwen | A01M 1/2077 239/37 |
| 2002/0146242 | A1 | 10/2002 | Vieira | |
| 2004/0033171 | A1 | 2/2004 | Kvietok et al. | |
| 2004/0076410 | A1 | 4/2004 | Zobele et al. | |
| 2005/0249673 | A1 | 11/2005 | Caserta et al. | |
| 2006/0180143 | A1 | 8/2006 | Lind et al. | |
| 2008/0265067 | A1 * | 10/2008 | Waterman | B05B 5/0255 239/690 |

FOREIGN PATENT DOCUMENTS

| | | |
|---|---|---|
| JP | 2010-155239 | 7/2010 |
| WO | WO 2012/098589 | 7/2012 |

OTHER PUBLICATIONS

European Search Report dated Jun. 3, 2016 issued in Application No. 13838581.0.
Chinese Office Action dated Jun. 28, 2016 issued in Application No. 201380054046.5 (English translation attached).

* cited by examiner

[Fig. 1] PRIOR ART
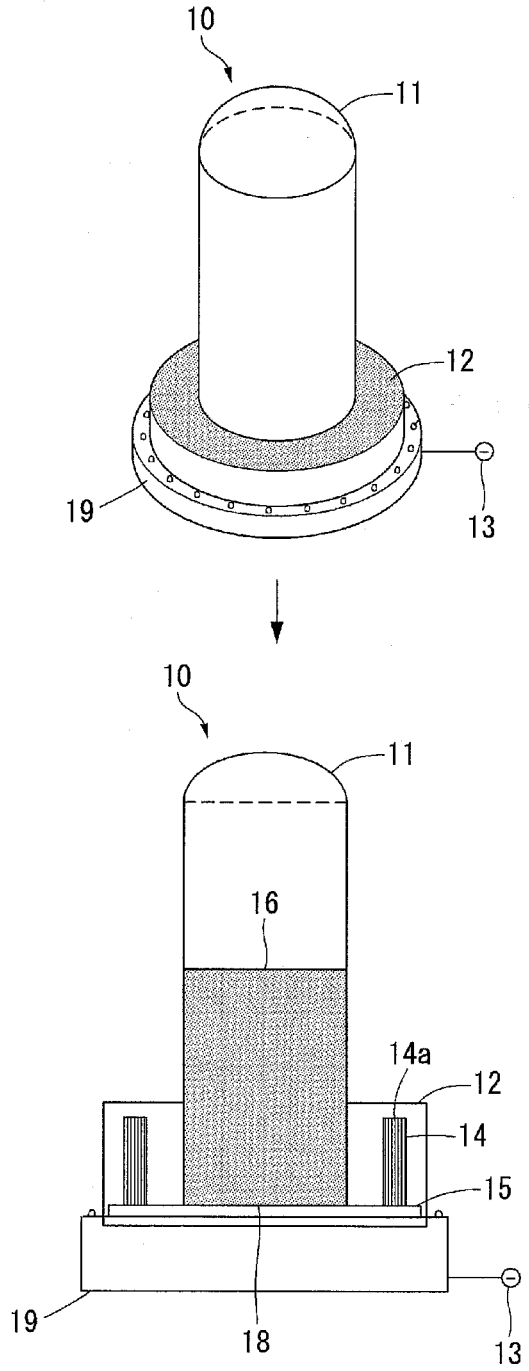

[Fig. 2]
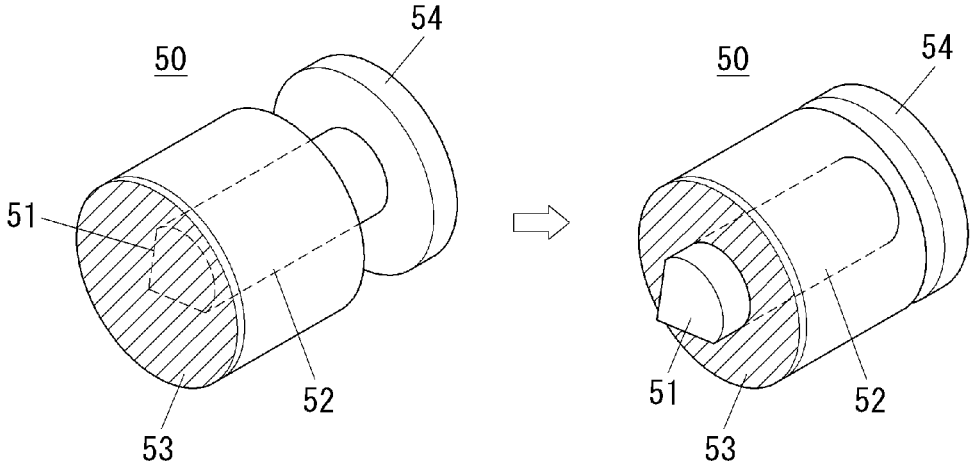
[Fig. 3]
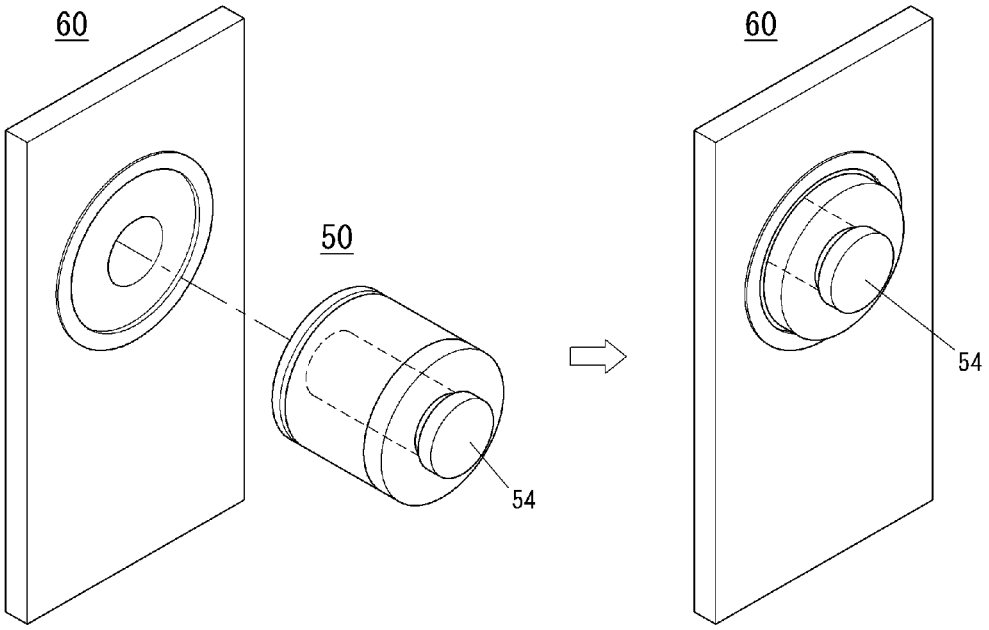

[Fig. 4]
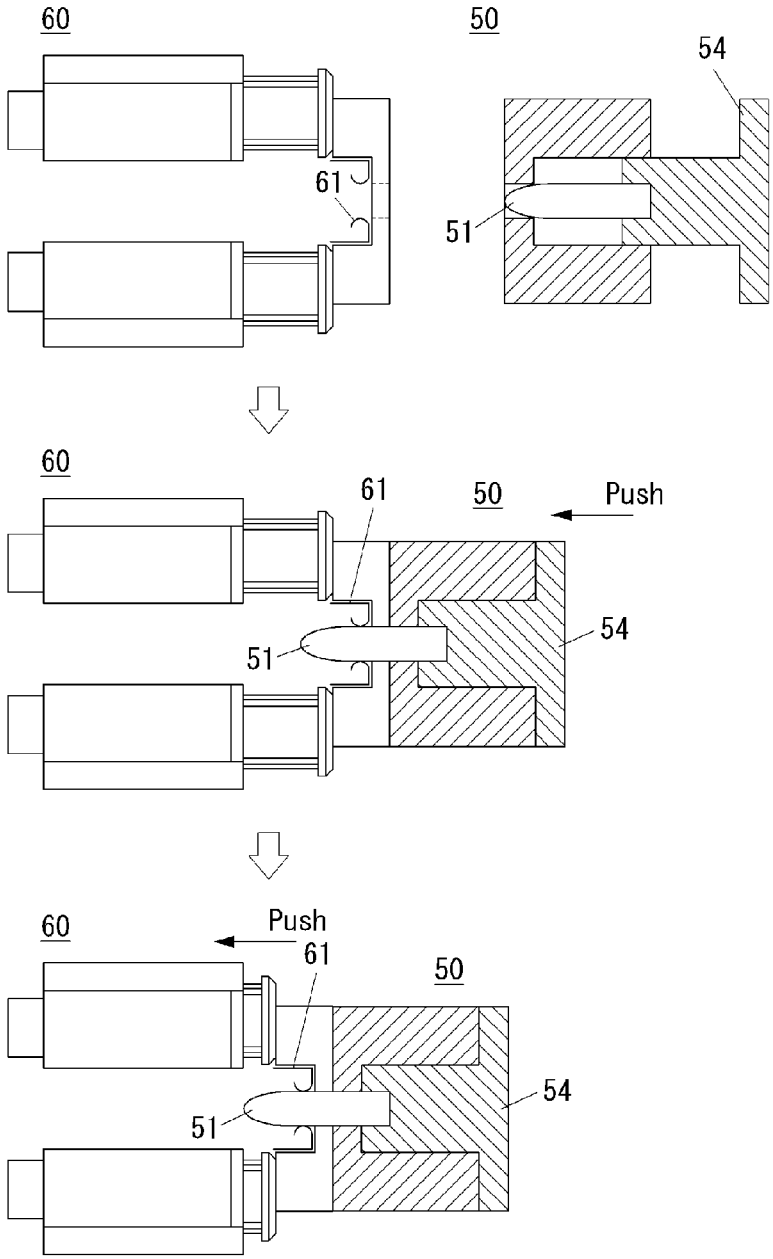
[Fig. 5]
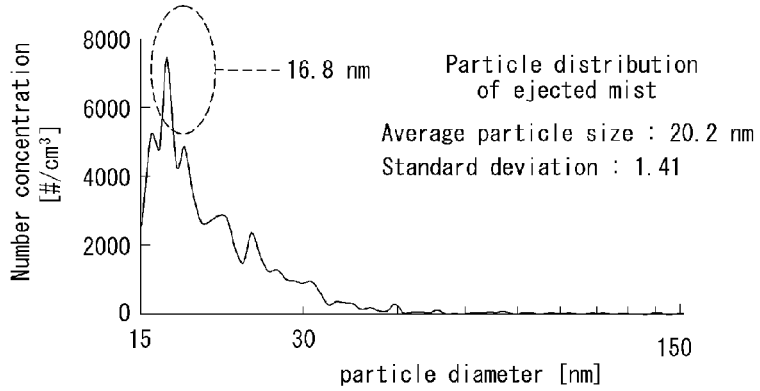

[Fig. 6]
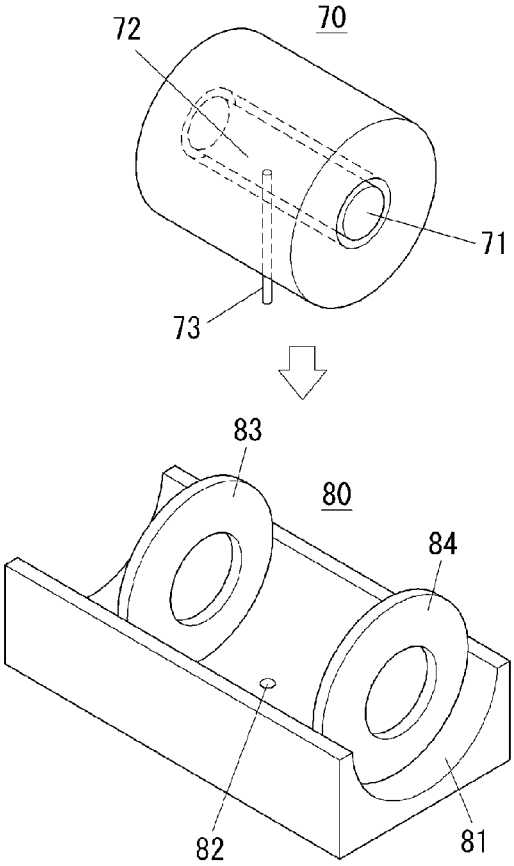
[Fig. 7]
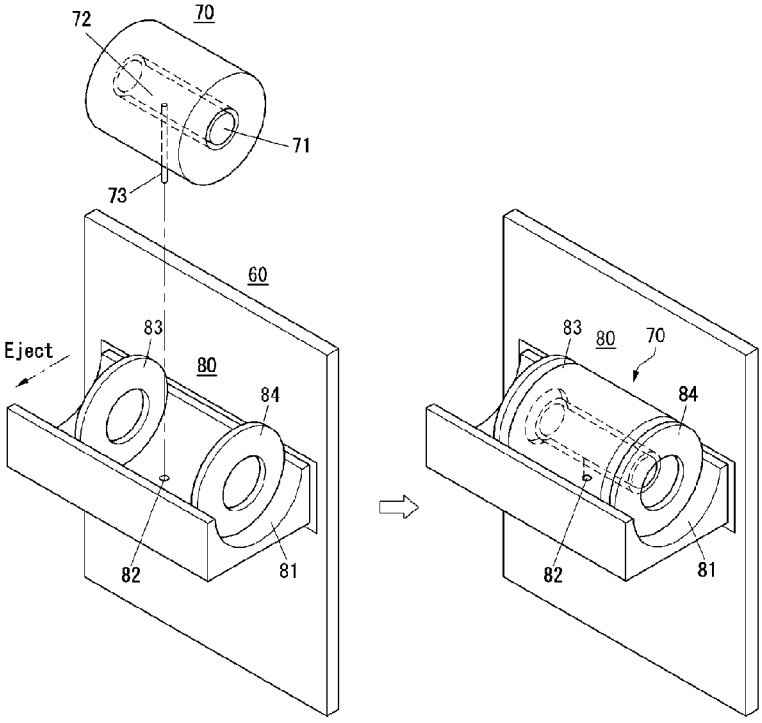

[Fig. 8]
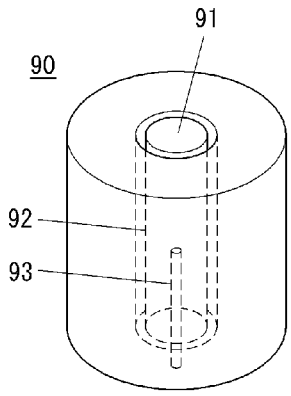
[Fig. 9]
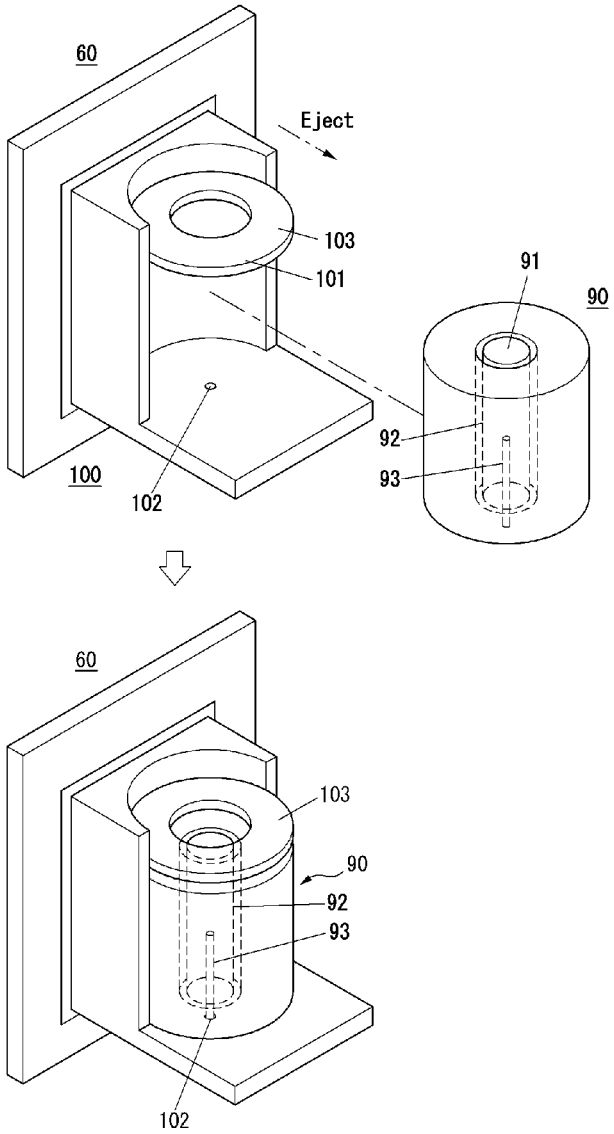

CAPSULE AND ELECTROSTATIC ATOMIZING DEVICE THEREOF

CROSS-REFERENCE TO RELATED PATENT APPLICATIONS

This application is a U.S. National Stage Application under 35 U.S.C. § 371 of PCT Application No. PCT/KR2013/008193, filed Sep. 11, 2013, which claims priority to Korean Patent Application No. 10-2012-0105834, filed Sep. 24, 2012, whose entire disclosures are hereby incorporated by reference.

TECHNICAL FIELD

The present invention relates to an electrostatic atomizing device of a disposable capsule having a functional water solution impregnated therein.

BACKGROUND ART

The electrostatic atomizing device used in different types of air conditioning apparatuses, such as refrigerators, air conditioners, air cleaners, humidifiers and facial treatment devices emits nano-sized super fine mist to air for exhibiting effects, such as deodoring room air, sterilization, and maintenance of freshness.

Referring to FIG. 1, the electrostatic atomizing device 10 is provided with a container 11 for holding a functional water solution 16, and a plurality of ejection pins 14 mounted around the container 11 for absorbing the functional water solution to emit the super fine mist.

Moreover, the electrostatic atomizing device 10 is also provided with a water retaining material 15 having the ejection pins 14 secured thereto, and a mounting pad 19 having a DC power source 13 connected thereto for applying power to the ejection pins 14, and a protective member 12 provided as a form of a cover on the mounting pad 19 for protecting the ejection pins 14.

And, the protective member 12 has a hole formed to have a diameter almost the same with a diameter of the container 11 for placing the container 11 in the water retaining material 15 matched to a center thereof.

The functional water solution 16 flows out to an inside of the porous water retaining material 15 through a membrane 18 under the container 11, and is impregnated throughout the water retaining material 15, naturally.

The functional water solution impregnated in the water retaining material 15 thus is absorbed in the ejection pin 14 by the capillary tube phenomenon, and ejected as a nano sized mist through a front end 14*a* of the ejection pin for exhibiting effects of deodoring room air, sterilization, maintenance of freshness, and so on.

However, since the electrostatic atomizing device ejects the functional water solution 16 from the container 11 in the nano sized mist over a long time period, if the functional water solution has a high viscosity, the electrostatic atomizing device has a problem in that a scaling phenomenon takes place in which the ejection pin 14 which is a porous medium is blocked.

Moreover, if the functional water solution in the container 11 is replaced with other kind of functional water solution, mixing the other kind of functional water solution with the functional water solution remained in the container 11 or the ejection pin 14 previously, the electrostatic atomizing device has problems in that a mist ejection performance becomes poorer, or the effects of the air deodoring, the sterilization, the maintenance of freshness and so on become poorer.

DISCLOSURE OF INVENTION

Technical Problem

Accordingly, the present invention has been made in an effort to solve the aforementioned problems, and it is an object of the present invention to provide a capsule and an electrostatic atomizing device thereof for improving a super fine mist ejection performance.

It is another object of the present invention to provide a capsule and an electrostatic atomizing device thereof which can prevent a scaling phenomenon in which an ejection pin which is a porous medium is blocked from taking place.

It is still another object of the present invention to provide a capsule and an electrostatic atomizing device thereof which can prevent functional water solutions of different composition from mixing with one another.

Solution to Problem

A capsule in accordance with an embodiment of the present invention includes an ejection pin having a functional water solution impregnated therein, a sealing member for sealing the ejection pin, and a pressing member for pushing the ejection pin with external force to move the ejection pin such that a portion of the ejection pin penetrates the sealing member and is projected to an outside of the capsule.

In accordance with an embodiment of the present invention, the ejection pin may be formed of a porous medium, and the porous medium may be a ceramic or carbon fiber electrode.

In accordance with an embodiment of the present invention, the sealing member may be aluminum foil formed on an opposite side of the pressing member.

In accordance with an embodiment of the present invention, the pressing member may have a piston shape.

An electrostatic atomizing device in accordance with one embodiment of the present invention includes a hole for receiving a capsule, and a voltage applying portion in the hole so as to be brought into contact with an ejection pin being projecting to an outside of the capsule received in the hole for applying a voltage to the ejection pin in contact with thus.

In accordance with an embodiment of the present invention, the electrostatic atomizing device may have a cigar jack shape.

A capsule in accordance with another embodiment of the present invention includes an ejection pin of a pillar shape having a functional water solution impregnated therein, a body for surrounding a side of the ejection pin and a needle of electrode to pass through a surface of the ejection pin to be brought into contact with the functional water solution and having a portion projected to an outside of the capsule.

In accordance with an embodiment of the present invention, the ejection pin may be formed of a porous medium.

In accordance with an embodiment of the present invention, the functional water solution may be a non-conductive liquid, and the functional water solution may be at least one of lavender, rosemary, and chamomile.

In accordance with an embodiment of the present invention, the needle of electrode may be formed of a material having a low work function, and may be formed of tungsten, or stainless steel.

In accordance with an embodiment of the present invention, the needle of electrode may be exposed to an outside of the capsule passed through a side of the body, and brought into contact with the functional water solution passed through the side of the ejection pin.

In accordance with an embodiment of the present invention, the needle of electrode may be exposed to an outside of the capsule passed through a bottom of the ejection pin.

An electrostatic atomizing device in accordance with another embodiment of the present invention includes a support for receiving a capsule of a pillar shape, an electrode hole for inserting a needle of electrode projected to an outside of the capsule therein, so as to be electrically connected to the needle of electrode inserted thus for applying a voltage thereto, and a ground electrode for connecting to a bottom of the capsule, electrically.

In accordance with an embodiment of the present invention, if the electrode hole is formed at a position of the support matched to the needle of electrode projected from a side of the capsule received in the support, two ground electrodes may be formed on the support at a capsule length distance such that the two ground electrodes are in contact with two bottoms of the capsule, respectively.

In accordance with an embodiment of the present invention, if the electrode hole is formed at a position of the support matched to the needle of electrode projected from one of the bottoms of the capsule received in the support, the ground electrode may be arranged to the support such that the ground electrode is in contact with the other one of bottoms in an opposite direction to the one of the bottoms where the needle of electrode of the capsule is formed thereon.

In accordance with an embodiment of the present invention, the support may be of a tray shape to be able to be pushed in/pulled out of an air conditioning apparatus.

In accordance with an embodiment of the present invention, a high voltage may be applied to the needle of electrode through the electrode hole after the support having the capsule received therein is pushed in the air conditioning apparatus.

Advantageous Effects of Invention

The electrostatic atomizing device of the present invention can prevent the scaling phenomenon in which the ejection pin is blocked from taking place by using a disposable capsule.

Moreover, the electrostatic atomizing device of the present invention, not only can prevent the functional water solutions of different composition from mixing with each other to prevent effects of air deodoring, sterilization, and maintenance of freshness from becoming poorer, but also improve user's convenience as replacement of the functional water solution becomes easier.

BRIEF DESCRIPTION OF DRAWINGS

FIG. 1 is a perspective view illustrating a related art atomizing device;

FIG. 2 is a perspective view illustrating a disposable capsule in accordance with a first preferred embodiment of the present invention;

FIGS. 3 and 4 are perspective views illustrating processes for coupling a disposable capsule to a driver in accordance with a first preferred embodiment of the present invention, respectively;

FIG. 5 is a graph illustrating a distribution of mist particle sizes of the present invention;

FIG. 6 is a perspective view illustrating a disposable capsule and a driver in accordance with a second preferred embodiment of the present invention;

FIG. 7 is a perspective view illustrating a process for coupling a disposable capsule to a driver in accordance with a second preferred embodiment of the present invention;

FIG. 8 is a perspective view illustrating a disposable capsule in accordance with a third preferred embodiment of the present invention; and FIG. 9 is a perspective view illustrating a process for coupling a disposable capsule to a driver in accordance with a third preferred embodiment of the present invention.

BEST MODE FOR CARRYING OUT THE INVENTION

In what follows, a capsule and an electrostatic atomizing device according to preferred embodiments of the present invention will be described in detail with reference to the appended drawings.

The electrostatic atomizing device of the present invention may be mounted in different types of air conditioning apparatuses, such as air cleaners, or air conditioners, or may be fabricated as a separate individual device.

The electrostatic atomizing device of the present invention uses a disposable capsule having an amount of functional water solution impregnated in a porous medium, such as a ceramic or carbon fiber electrode, enough to use about 2~3 hours for preventing a scaling phenomenon in which an ejection pin is blocked from taking place.

Moreover, the electrostatic atomizing device of the present invention uses the disposable capsule which can be placed in the device easily for the user to use a functional water solution of user's selection.

Referring to FIG. 2, the disposable capsule 50 in accordance with a first preferred embodiment of the present invention may be fabricated in different shapes, such as a small sized cylinder, or a small sized polygonal pillar, such as a square pillar, hexagonal pillar, and octagonal pillar, the ejection pin 51 which is a porous medium has the functional water solution 52 impregnated therein, and the capsule has a surface thereof sealed with a sealing member 53, such as aluminum foil, for preventing the functional water solution 52 from dispersing through the ejection pin 51, naturally.

If a pressing member 54 like a piston in a rear side of the ejection pin 51 is moved by external force, for an example, pressing with a user's hand, the ejection pin 51 projects to an outside of the capsule penetrating the sealing member 53. Since the pressing member 54 and the sealing member 53 form a top and a bottom sides of the capsule 50 of the cylindrical or polygonal pillar respectively, and a side of the capsule 50 is formed of a sealing member of a solid material, such as plastic, the ejection pin 51 is enclosed so as not to be exposed to an outside of the capsule.

Referring to FIG. 3, the ejection pin 51 projected to an outside of the disposable capsule thus is placed in a hole in a driver 60 formed in a front or a side of the air conditioning apparatus, such as the air cleaner, and the air conditioner.

The driver 60 has a structure similar to a cigar jack insert, or a ball pointed pen spring, to enable a conductor that can apply a voltage to be brought into contact with the ejection pin 51.

Referring to FIG. 4, since the driver 60 has a voltage applying portion 61 of a conductor to be in contact with the ejection pin 51 being inserted into an inside through a hole provided thereto, if the user presses the pressing member 54 of the disposable capsule with a hand in a state the disposable capsule 50 is matched with the hole in the driver 60, the ejection pin 51 is inserted in, and brought into contact with, the voltage applying portion 61 through the hole in the driver as the ejection pin 51 penetrates through the sealing member 51, and is projected to the outside of the disposable capsule.

And, if the user pushes the pressing member 54 of the disposable capsule further, since the spring (Not shown) in the driver 60 comes into action, the air conditioning apparatus and the disposable capsule perfectly fastened closely. In this time, since a voltage is applied to ejection pin 51 through the voltage applying portion 61, the functional water solution 52 impregnated in the ejection pin 51 is atomized to form the nano-sized super fine mist.

The mist formed thus is discharged to an outside of the air conditioning apparatus carried on an air flow generated by the air conditioning apparatus, wherein unipolar charged droplets at a droplet atomizing voltage (For an example, 6~7 KV) from the voltage applying portion 61 are carried by the air flow and discharged to the outside of disposable capsule, and has improved spatial diffusibility by repulsive force among the droplets.

Referring to FIG. 5, according to a result of experiment of the present invention, the mist has a particle size in a level of 20 nm in average, and, as the functional water solution, different materials, such as vitamin C (L-ascorbic acid), phytoncide, a solution of aroma perfume, and so on may be used.

Eventually, the user may use the disposable capsule 50 by selecting and inserting the disposable capsule 50 having the functional water solution of a desired composition impregnated therein in the driver 60 of a cigar jack shape provided in the front or the side of the air conditioning apparatus, simply.

In the meantime, FIG. 6 is a perspective view illustrating a disposable capsule and a driver in accordance with a second preferred embodiment of the present invention.

Since a non-conductive liquid, such as a natural essential oil, for an example, lavender, rosemary, chamomile, and so on, has almost no ions which can serve as a charge, and very low electric conductivity, it is not possible to charge the non-conductive liquid, easily.

Referring to FIG. 6, the disposable capsule in accordance with a second preferred embodiment of the present invention suggests using a charge injection type disposable capsule 70 of a cylinder with a circular hole formed therein, but not limited to the cylinder or the circular hole, but may have different shapes, such as a square, a pentagon, a hexagon, and so on, including an ejection pin 71 of a shape, for an example, a cylinder shape, mounted in a length direction of the hole in the cylinder, a functional water solution 72 impregnated in the ejection pin 71 of a porous medium, a needle of electrode 73 passed both through a side of the disposable capsule and a surface of the ejection pin 71 for being brought into contact with the function water solution 72, with a portion of the needle of electrode 73 projected to an outside of the disposable capsule. The needle of electrode 73 may be formed of tungsten or stainless steel having a low work function for inducing stable charge injection.

The air conditioning apparatuses, such as the air cleaner or the air conditioner, may have a driver 80 of a tray shape mounted therein in a front or a side thereof for inserting the disposable capsule 70 having the portion of the needle of electrode 73 projected therefrom in a width direction. As shown in FIG. 6, the driver 80 has a semi-circular support 81 for supporting the cylindrical disposable capsule, an electrode hole 82 formed therein for applying a voltage to the needle of electrode 73 projected from the side of the disposable capsule 70, and two donut shaped first ground electrode 83 and second ground electrode 84 mounted adjacent to two bottoms of the disposable capsule to be inserted in the support 81.

And, referring to FIG. 7, since the driver 80 may be fabricated in a tray shape which is inserted in or ejected from the air conditioning apparatus, the user seats the disposable capsule 70 by inserting the disposable capsule 70 from an upper side to a lower side simply in a state the tray shaped driver 80 is ejected, and, if the driver 80 having the disposable capsule 70 seated therein is inserted in the air conditioning apparatus, a high voltage is applied to the needle of electrode 73 through the electrode hole 82, to apply the high voltage between the needle of electrode 73 and the first ground electrode 83 and the second ground electrode 84 making the needle of electrode 73 to emit electrons.

And, a fluid in the vicinity of the electrons emitted thus is charged, so that the fluid charged thus is atomized and ejected to an outside of the disposable capsule from both ends of the ejection pin 71 by electric force stronger than surface tension of the fluid, thereby ejecting nano-sized super fine mist from both sides of the ejection pin 71.

Though FIG. 7 illustrates two ground electrodes 83 and 84 arranged at a length distance of the capsule to be in contact with the two bottom of the capsule in the driver 80, the present invention is not limited to this, but only one ground electrode may be arranged on one side, while the other side may have a stopper arranged at the length distance of the capsule for securing the capsule thereto.

Eventually, the user may use the disposable capsule 70 having a functional water solution of a desired composition impregnated therein by inserting the disposable capsule 70 in the tray shaped support of the driver 60 to the front or the side of the air conditioning apparatus, simply.

In the meantime, FIG. 8 is a perspective view illustrating a disposable capsule in accordance with a third preferred embodiment of the present invention. As described before, since a non-conductive liquid, such as a natural essential oil, for an example, lavender, rosemary, chamomile, and so on, has almost no ions which can serve as a charge, and very low electric conductivity, it is not possible to charge the non-conductive liquid, easily.

Referring to FIG. 8, the disposable capsule in accordance with a third preferred embodiment of the present invention suggests using a charge injection type disposable capsule 90 of different shapes, such as a small sized cylinder or polygonal pillar, including a functional water solution 92 impregnated in an ejection pin 91 of a porous medium, and a needle of electrode 93 passed through a bottom of the disposable capsule for being brought into contact with the functional water solution 92, with a portion of the needle of electrode projected to an outside of the disposable capsule. The needle of electrode may be formed of tungsten or stainless steel having a low work function for inducing stable charge injection.

The air conditioning apparatuses, such as the air cleaner or the air conditioner, may have a driver 100 of a vertical tray shape mounted therein in a front or a side thereof for inserting the disposable capsule 90 in a vertical direction to have the portion of the needle of electrode 93 projected therefrom. As shown in FIG. 8, the driver 100 includes a vertical semi-circular support 101 for supporting the disposable capsule to be inserted in a length direction, an electrode hole 102 formed therein for applying a voltage to the needle of electrode 93 projected through a bottom of the disposable capsule 90, and a donut shaped first ground electrode 103 mounted to a portion thereof the disposable capsule is to be seated thereon. The support 101 has a shape varied with an outside shape of the capsule for supporting the capsule, wherein, if the capsule is a cylindrical pillar, the support is semi-circular, and, if the capsule is polygonal, the support has a shape matched to the polygonal shape.

And, referring to FIG. 9, since the driver 100 may be fabricated in a vertical tray shape which is inserted in or ejected from the air conditioning apparatus, the user seats the disposable capsule 90 by inserting the disposable capsule 90 in a standing position in a length direction in a state the tray shaped driver 100 is ejected, and, if the driver 100 having the disposable capsule 90 seated therein is inserted in the air conditioning apparatus, a high voltage is applied to the needle of electrode 93 through the electrode hole 102, to apply the high voltage between the needle of electrode 93 and the first ground electrode 103 making the needle of electrode 93 to emit electrons.

And, the fluid in the vicinity of the electron emitted thus is charged, so that the fluid charged thus is atomized and ejected to an outside of the capsule by an electric force stronger than a surface tension of the fluid, thereby ejecting nano-sized super fine mist from both sides of the ejection pin 91.

When the capsule 90 is fastened to the driver 100 with the needle of electrode 93 inserted in the electrode hole 102, it is possible to make the first ground electrode 103 movable in a length direction such that the first ground electrode 103 is in contact with a bottom or a top of the capsule 90 having no needle of electrode 93 formed thereon.

As have been described, the capsule and the electrostatic atomizing device of the present invention have the following advantages.

While this invention has been described in connection with what is presently considered to be practical exemplary embodiments, it is to be understood that technical aspects of the present invention are not limited to the exemplary embodiments suggested in the specification, but, though a person of an ordinary skill in this field of art who understand the technical aspects of the present invention can suggest another exemplary embodiment by modifications, changes, removal, and addition of constituent elements within a range of technical aspects the same with the present invention, it may also be within a range of right of the present invention.

The invention claimed is:

1. A capsule comprising:

an ejection pin having a functional water solution impregnated therein;

a sealing member configured to seal the ejection pin such that the ejection pin is enclosed within the capsule; and a pressing member configured to push the ejection pin to move a portion of the ejection pin from an inside of the capsule towards an outside of the capsule, wherein the portion of the ejection pin penetrates the sealing member and is projected to the outside of the capsule when the pressing member is pushed by an external force.

2. The capsule as claimed in claim 1, wherein the ejection pin is formed of a porous medium.

3. The capsule as claimed in claim 2, wherein the porous medium is a ceramic or carbon fiber electrode.

4. The capsule as claimed in claim 1, wherein the sealing member is aluminum foil formed on a side of the capsule opposite from the pressing member.

5. The capsule as claimed in claim 1, wherein the pressing member has a piston shape.

6. An electrostatic atomizing device comprising the capsule as claimed in claim 1 and a driver, wherein the driver comprising:

a hole for receiving the capsule; and a voltage applying portion in the hole so as to be brought into contact with the ejection pin projecting to the outside of the capsule received in the hole for applying a voltage to the ejection pin in contact with the voltage applying portion such that the functional water solution impregnated in the ejection pin is atomized.

* * * * *